US007361127B2

(12) United States Patent
Tremayne

(10) Patent No.: US 7,361,127 B2
(45) Date of Patent: Apr. 22, 2008

(54) EXERCISE DEVICE

(76) Inventor: Terrence Colin Tremayne, 46 Alma Road, St Kilda, Victoria, 3182 (AU)

( * ) Notice: Subject to any disclaimer, the term of this patent is extended or adjusted under 35 U.S.C. 154(b) by 616 days.

(21) Appl. No.: 10/466,363

(22) PCT Filed: Jan. 18, 2002

(86) PCT No.: PCT/AU02/00053

§ 371 (c)(1),
(2), (4) Date: Jul. 16, 2003

(87) PCT Pub. No.: WO02/056971

PCT Pub. Date: Jul. 25, 2002

(65) Prior Publication Data

US 2004/0053756 A1 Mar. 18, 2004

(30) Foreign Application Priority Data

Jan. 18, 2001 (AU) ..... PR2618

(51) Int. Cl.
*A63B 21/08* (2006.01)

(52) U.S. Cl. ..... 482/130; 482/121

(58) Field of Classification Search ..... 482/130, 482/142, 140, 121, 126, 135, 125
See application file for complete search history.

(56) References Cited

U.S. PATENT DOCUMENTS

| | | | | |
|---|---|---|---|---|
| 5,002,271 | A | 3/1991 | Gonzales | |
| 5,044,633 | A * | 9/1991 | Rice | 482/138 |
| 5,080,353 | A * | 1/1992 | Tench | 482/130 |
| 5,090,694 | A | 2/1992 | Pauls et al. | |
| 5,110,121 | A | 5/1992 | Foster | |
| 5,116,359 | A | 5/1992 | Moore | |
| 5,267,926 | A * | 12/1993 | Schaefer | 482/94 |
| 5,324,243 | A | 6/1994 | Wilkinson | |
| 5,885,106 | A * | 3/1999 | Genta et al. | 439/595 |
| 5,967,610 | A * | 10/1999 | Lin | 297/340 |
| 6,056,675 | A | 5/2000 | Aruin et al. | |
| 6,099,445 | A * | 8/2000 | Rovinsky et al. | 482/121 |
| 6,689,025 | B2 * | 2/2004 | Emick | 482/123 |

FOREIGN PATENT DOCUMENTS

| | | |
|---|---|---|
| DE | 20000466 U | 3/2000 |
| WO | WO 84/04690 | 5/1983 |

* cited by examiner

*Primary Examiner*—Jerome Donnelly
(74) *Attorney, Agent, or Firm*—Barnes & Thornburg LLP

(57) ABSTRACT

An exercise device for mounting to a chair, the device including a resistance means having a resilient means with a length. The resilient means is linked to first and second operating means at respective opposite ends of the resilient means, whereby movement of at least one of the first and second operating means permits exercise against the resilient means.

16 Claims, 12 Drawing Sheets

EXERCISE DEVICE

BACKGROUND OF INVENTION

This invention relates to improvements in exercise devices capable of being attached to or integrated with a chair and relates, in one form, to an improved design that is easily detachable and compact enough to be portable.

PRIOR ART

Many of the inventions that adapt a chair to an exercise machine claim to exercise all muscle groups, but to do so they require the engineering of a completely new chair capable of housing a variety of cables, pullies, resistance mechanisms and weights inside the chair which makes them complicated and expensive to manufacture. Inventions that attach to a chair are often aesthetically ugly, cumbersome to adjust to different exercises and can realistically only exercise a limited number of muscle groups.

Recent research of work related injuries shows that back, neck, wrist and other injuries caused by long periods of sitting, or doing desk work account for over 50% of work days lost and apart from causing discomfort to the injured it is a significant cost to employers. These injuries can be reduced, or eliminated by doing simple "chair exercises" which include stretching, pushing, or pulling against a chair or another fixed piece of furniture every hour or so during the day.

It is also known that resistance exercising (pulling a simple resistance cord with a handle at each end and holding for say a count of 5) is up to 40% more effective than free weight exercising or peddling a bicycle. Approximately 10 minutes of reasonably energetic (not strenuous) exercise per day is sufficient to maintain reasonable health and fitness for the average person and that exercise done during the day is cumulative in effect, i.e. five short exercise sessions of 2 minutes, or ten sessions of just 1 minute is almost as effective as a single 10 minute exercise session. Furthermore, with over 30% of the workforce and all school children spending most of their time in a chair, there is ample opportunity for engaging in "chair exercises".

It is therefore desirable to provide an improved exercise device which, at least in part, alleviates some of the shortcomings of current exercise devices.

SUMMARY OF INVENTION

In accordance with one aspect of the invention there is provided an exercise device for mounting to a chair, the device including a first resistance means that includes a resilient means having a length and which resilient means is linked to first and second operating means at respective opposite ends of the resilient means whereby movement of the first and/or second operating means enables exercise against said resilient means and wherein an intermediate portion of said length is looped around a plurality of spaced pulleys such that said first and second operating means are spaced by a distance less than said length when said resilient means is at rest, and are operable, during exercise, to be spaced by a distance greater than said length.

In one particular embodiment of the first aspect, at least one of said plurality of pulleys is associated with the second operating means for movement therewith such that the resistance experienced by movement of the second operating means is greater than the resistance experienced by movement of the first operating means. A further embodiment of the first aspect provides that the respective opposite ends of the resilient means are linked to the first operating means and an abutment. Preferably, the first aspect of the invention includes removable chair mounting means enabling removable mounting of the exercise device to a chair for portability.

A second aspect of the invention provides an exercise device for mounting to a chair, the device including:

a resistance means that includes a resilient means having a length and which resilient means is linked to first and second operating means at respective opposite ends of the resilient means whereby movement of the first and/or second operating means enables exercise against said resilient means; and means for removable mounting of the device to a chair such that the device is portable.

The invention provides in a third aspect an exercise device for mounting to a chair, the device including:

a resistance means that includes a resilient means having a length and which resilient means is linked to first and second operating means at respective opposite ends of the resilient means whereby movement of the first and/or second operating means enables exercise against said resilient means; and means for mounting the device to a chair such that the first and second operating means are displaceable between a first operating position and a second position for storage when the device is mounted to the chair and not being used.

The exercise device of each aspect preferably includes a further resistance means located inside a housing to provide bias against extension of the resistance means.

According to each aspect, the first operating means preferably is a handle and the resilient means is an elastic cord or spring.

In this embodiment the resistance experienced through extension of the cord means by movement of the second operating means is four times greater than that experienced through movement of the handle. This is due to movement of the second operating means requiring extension of four sections of the cord means as opposed to one section when the handle is used. However, when the hook is attached to the handle, the resistance through the handle doubles as a user must extend two sections of the cord means while the resistance through the second operation means remains as it previously was. In this arrangement, the resistance through the second operating means is merely double that experienced through the handle.

The second operating means of each resistance means may include a stirrup adapted for use with a user's foot. In a preferred embodiment the second operating means is a common operating means connecting the opposite end of each resistance means whereby movement of the common operating means is against both resistance means. The common operating means may include a bar, rod or tube.

In a further embodiment the common operating means is an extendable footrest with two separate foot-receiving means adapted for relatively slidable movement whereby the two foot-receiving means are biased together by further resistance means such that movement of the two foot-receiving means enables exercise against the further resistance means. Preferably, the slidable movement of the two foot-receiving means is coaxial with a support bar joining the two foot-receiving means.

In preference, the resistance means includes a housing comprising at least one component, but preferably comprising at least two components that co-operate to telescopically accommodate extension of the resistance means. The uppermost and lowermost components of the housing of each resistance means are pivotally attached respectively to an extension bar and the common operating means by universal joints. The universal joints preferably comprise a ball and socket joint, but may alternatively be linked rings, a flexible polymeric connection, or a pair of connections rotatable about mutually orthogonal axes.

It is also preferable that the portable exercise device is adapted to be removably mounted on a standard office chair. The removable chair-mounting means preferably further includes a central mounting device and one or more arms extending from the central mounting device. Each of the one or more arms is attached to or supports a resistance means or each of the one or more arms is connected via an extension bar to the resistance means. In a preferred embodiment, the central mounting device comprises a clamp in the form of a generally cylindrical tube and wherein each of the one or more arms is pivotable about an axis coaxial with an axis of the cylindrical clamp. It is further preferable that each of the one or more arms is pivotable between first operating positions and a second position where one or more of the resistance means is substantially flush with the chair for out-of-the-way storage.

In one particular embodiment, the handle includes a channel in which an abutment, attached to the end of the resistance means is slidable. The handle has an aperture which permits the ingress and egress of the abutment from the channel.

A preferred embodiment of the present invention will now be described, by way of example only, with reference to the accompanying drawings, in which.

DESCRIPTION OF THE PREFERRED EMBODIMENTS

Figure 1:
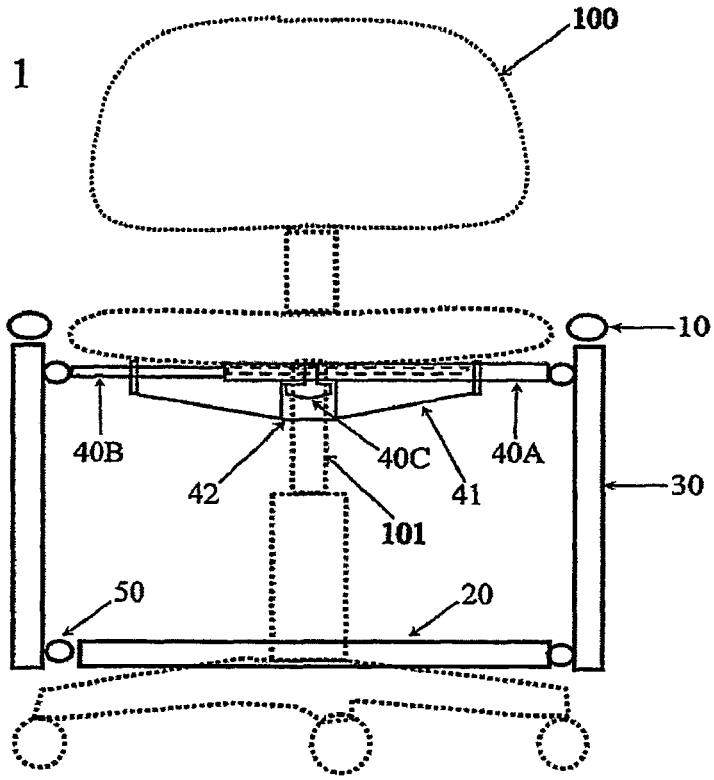
FIG. 1 is a front perspective view of a portable exercise device, in accordance with the invention, attached to a standard office chair.
Figure 2:
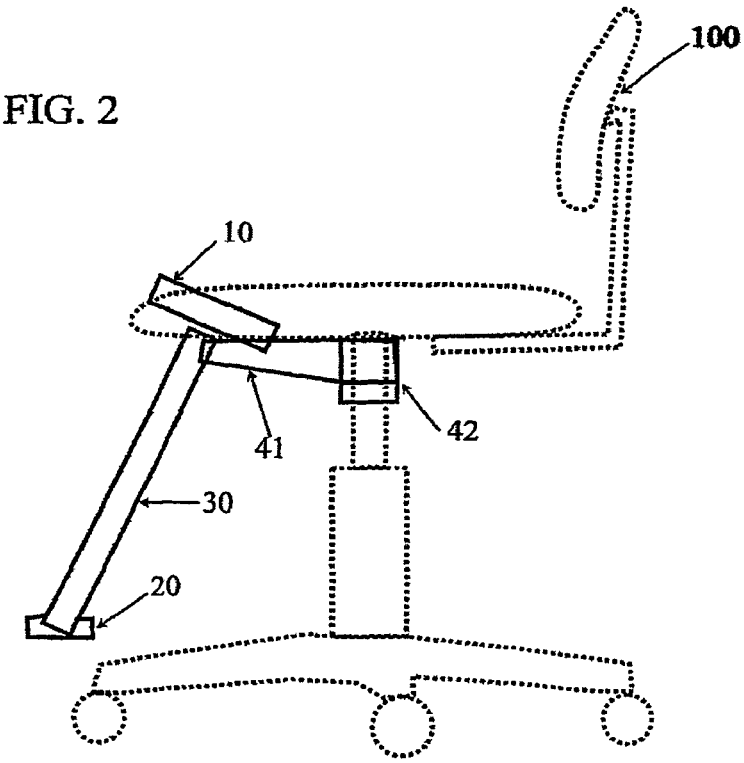
FIG. 2 is a side view of the exercise device.

The portable exercise device shown in FIGS. 1 and 2 comprises a chair attachment means 40, 41, 42, 43, resistance means 30, a second operating means in the form of a common operating means 20, handles 10 at the end of each resistance means and universal joints 50 connecting the operating means 20 to the resistance means 30 and the resistance means 30 to the chair attachment means 40, 41, 42, 43.

The chair attachment means 40, 41, 42, 43 enables the device to be removed from a chair and re-attached to other chairs, thereby providing the device with portability. However, it is clear that the device may be adapted to be mounted permanently or integrated into a chair by a suitable fixing means, eg. bolts, welding or bonding adhesive. For instance, the chair attachment means 40, 41, 42, 43 may be omitted in favour of the universal joints 50 being mounted directly. on the chair.

Figure 3:
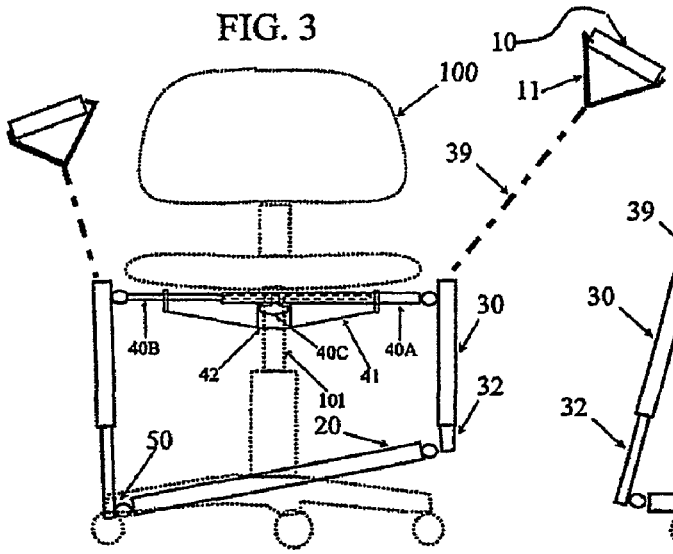
FIGS. 3 and 4 are front perspectives of the freedom of movement available in the exercise device.
Figure 4:
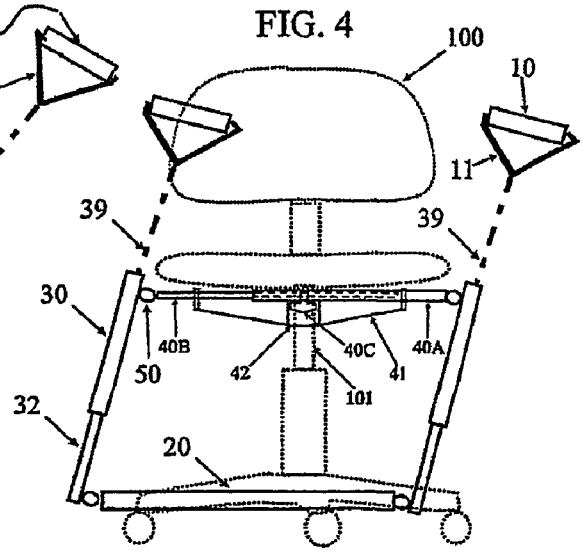
Figure 5:
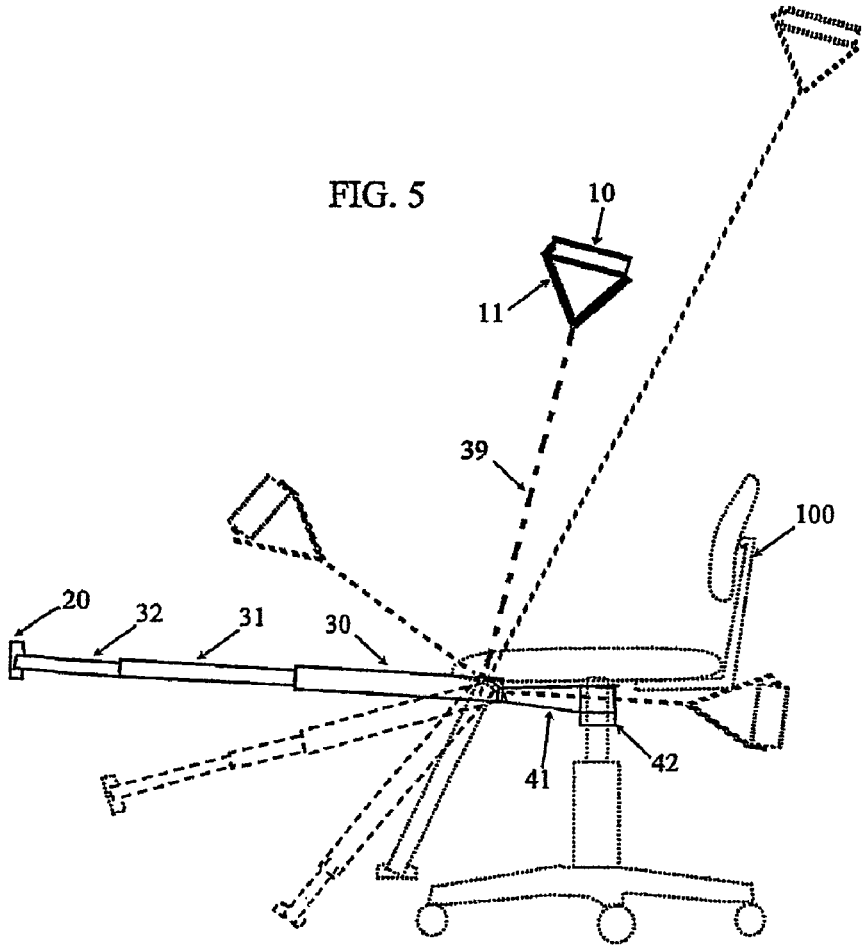
FIG. 5 is a side perspective of the range of movement available in the exercise device.
Figure 6:
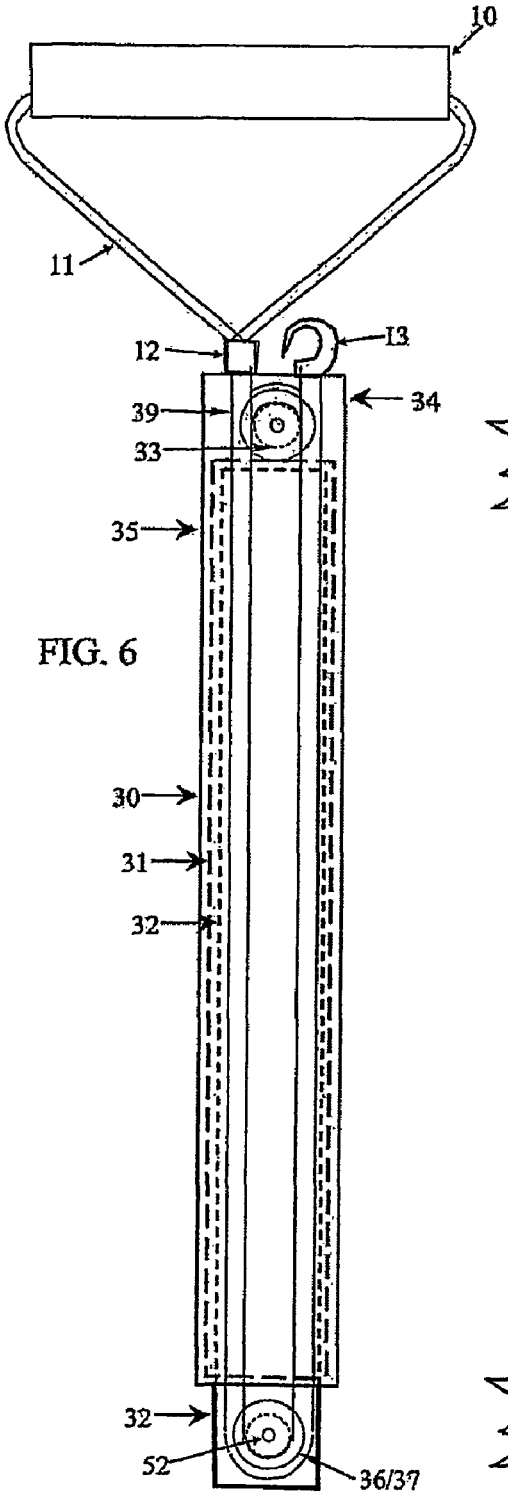
FIG. 6 is a side view schematic of a resistance means with a three component housing.
Figure 7:
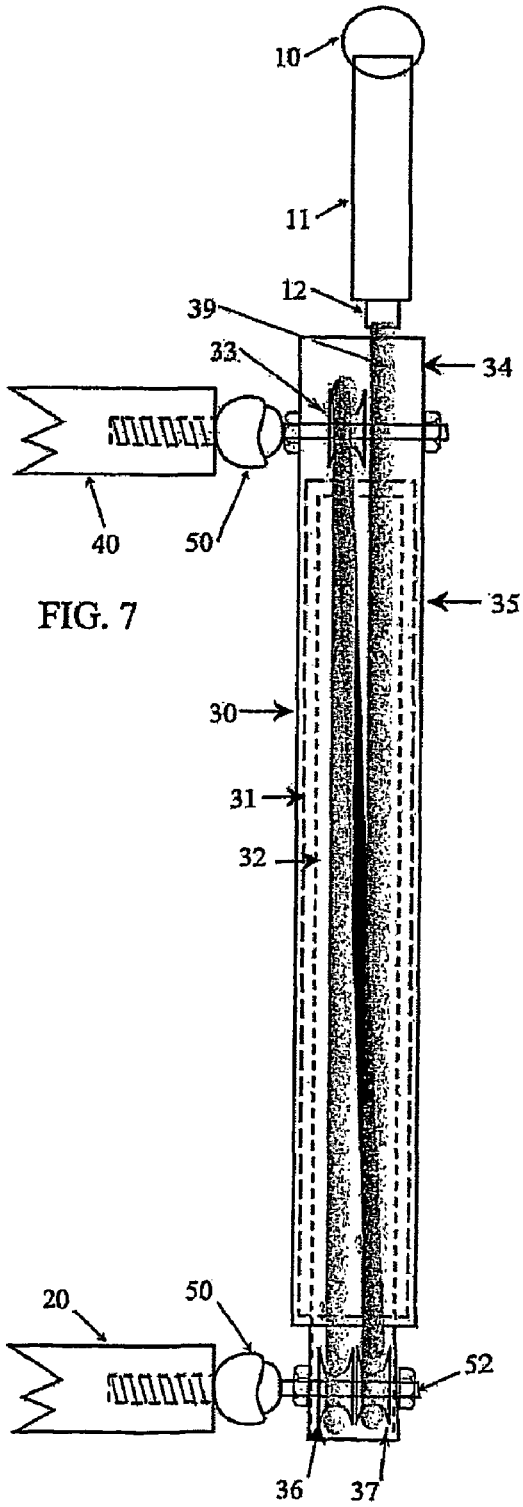
FIG. 7 is a schematic front view of the resistance means depicted in FIG. 6.
Figure 8:
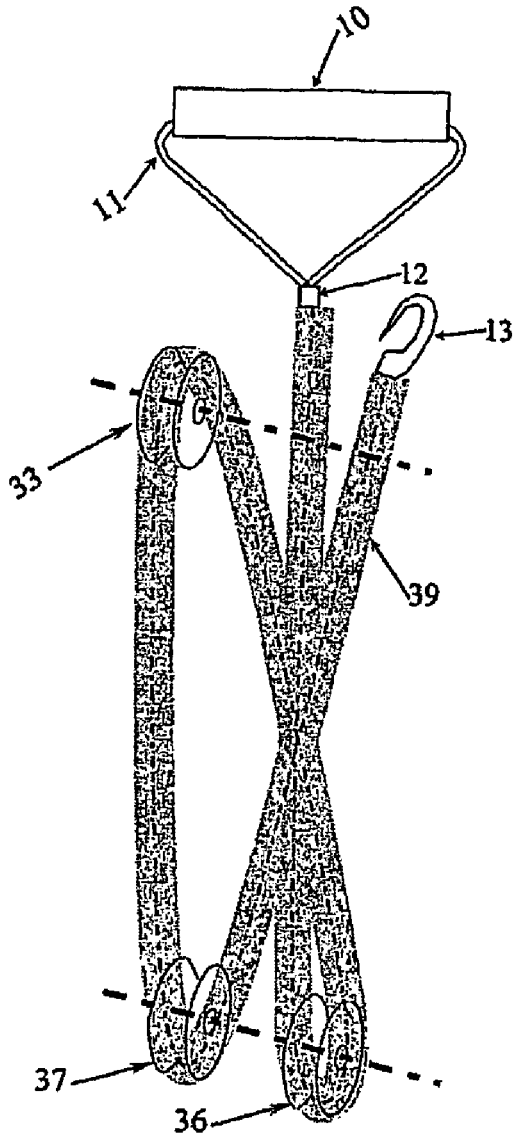
FIG. 8 shows the arrangement of the elastic cord in a resistance means comprising three pulley wheels.
Figure 9:
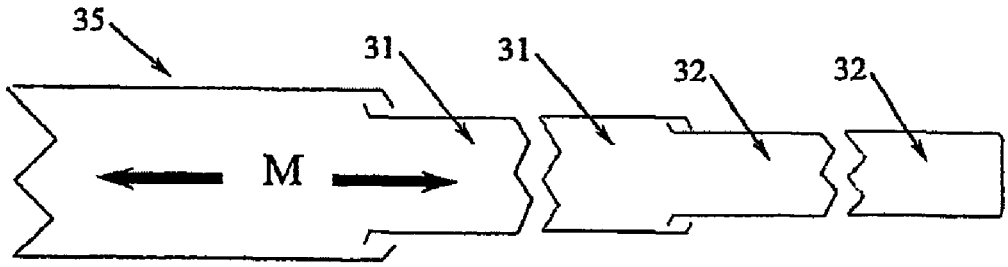
FIG. 9 is a schematic of a three component housing.

As depicted in FIGS. 6 and 7, the resistance means 30 preferably comprises a rubberised elastic cord 39 maintained within a housing 35 made up of three components 31, 32, 34 which together operate telescopically. The elastic cord may be substituted with appropriate alternatives, such as a coil spring or elastic straps. The elastic cord 39 is attached to handle 10 at one end and terminates at its opposite end at a fixture in the uppermost component 34 of the resistance means 30. The resistance means 30 is described in greater detail at a later stage. In this manner, and with the universal joints 50 connecting the common operating means 20, resistance means 30 and chair attachment means 40, 41, 42, 43, the common operating means 20 and handles 10 may be extended by any movement lateral, longitudinal or combination thereof by the user's arms or legs in relation to the direction in which the user is facing, as shown in FIGS. 3, 4 and 5.

Figure 10:
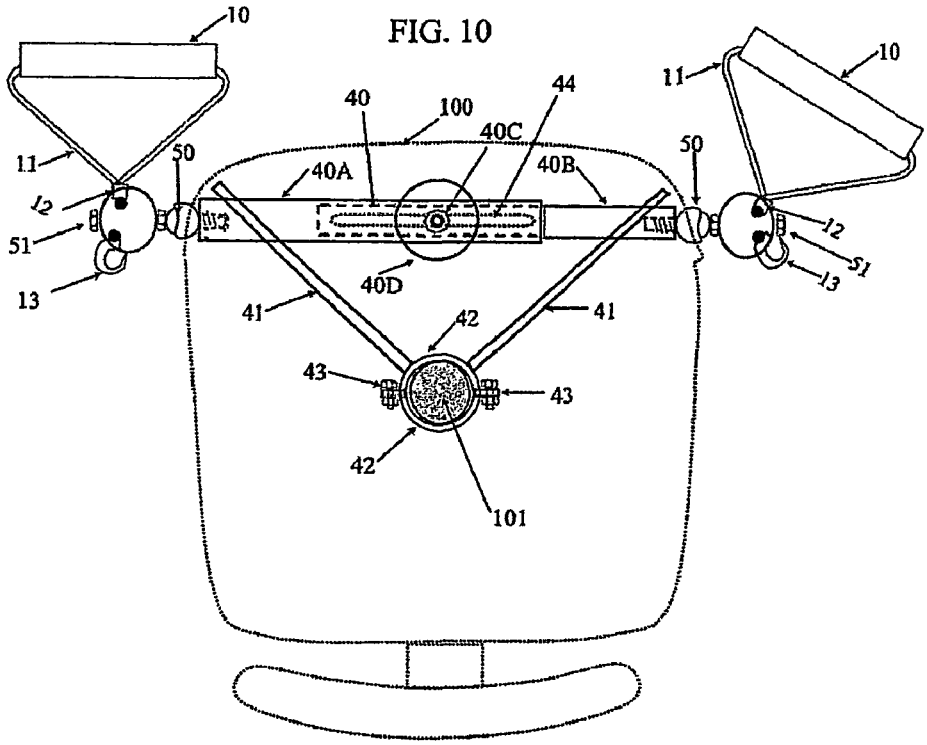
FIG. 10 is a top perspective of the exercise device (footrest not shown) attached to a standard office chair.
Figure 11:
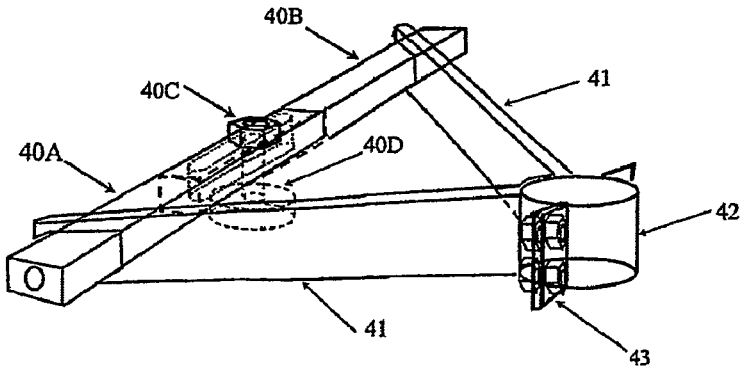
FIG. 11 is a perspective view of the chair attachment frame and clamp.

The chair attachments means 40, 41, 42, 43, shown in FIGS. 10 and 11, comprises a clamp 42 which is fixed to the centre post of a standard office chair 101, two divergent struts 41 and an extension bar 40 which can be adjusted in length to accommodate chairs of different widths.

The clamp 42 is composed of two opposed semi-circular portions 42, which when placed opposite one another substantially form a cylindrical tube. The semi-circular portions 42 have a lug on each end and each lug has two holes through which bolts 43 may be passed to releasably secure the semi-circular portions 42 together and thereby clamp the exercise device to the chair post 101. Attaching the exercise device to the chair post 101 has the advantage of allowing the exercise device to pivot with the chair so it always remains in the same position relative to the user regardless of chair rotation.

The exercise device can easily be removed from the chair by releasing the bolts and opening the clamp. This allows the exercise device to be transported and placed on any chair by simply fitting the clamp.

Two divergent arms extend from one semi-circular portion 42 of the clamp 42, 43. The ends of each arm 41 include cut-out portions which receive therethrough a telescopically extendable bar 40. The bar 40 includes an outer sleeve 40A and an inner sleeve 40B which co-operate to provide the telescopic extension. The outer sleeve 40A has a rectangular tubular cross-section and a hole passing through its top and bottom surfaces at a position near the end which receives the inner sleeve 40B.

The inner sleeve 40B also has a rectangular cross-section which may be either tubular or solid. The inner sleeve 40B is dimensioned to comfortably fit inside the tubular section of the outer sleeve 40A. An elongated hole 44, cut between the top and bottom sides of the inner sleeve, is located near the end of the inner sleeve 40B which is enclosed by the outer sleeve 40A and extends approximately half the length of the inner sleeve 40B.

A nut 40C is welded or otherwise fixedly secured over the hole in the top surface of the outer sleeve 40A and a threaded bolt 40D is passed through the hole in the bottom surface of the outer sleeve 40A, the elongate hole 44 in the inner sleeve 40B and the hole in the top surface of the outer sleeve 40A to threadedly engage with the nut 40C. By such engagement the inner and outer sleeves 40A, 40B can be adjusted to a desired length and then retained in that extension by frictional resistance from the bolt 40D being tightened. This means of adjustment allows the exercise device to be adapted to fit chairs of different widths.

Figure 22:
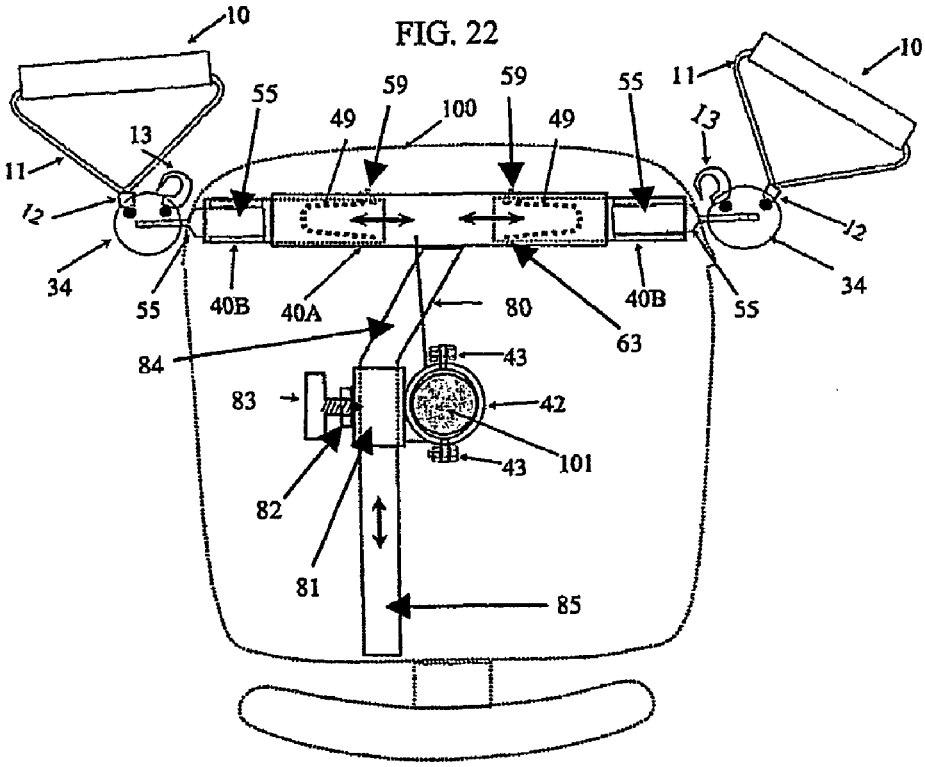
FIG. 22 is a top view schematic of a further alternative chair attachment means, with a primary arm in a retracted position.
Figure 23:
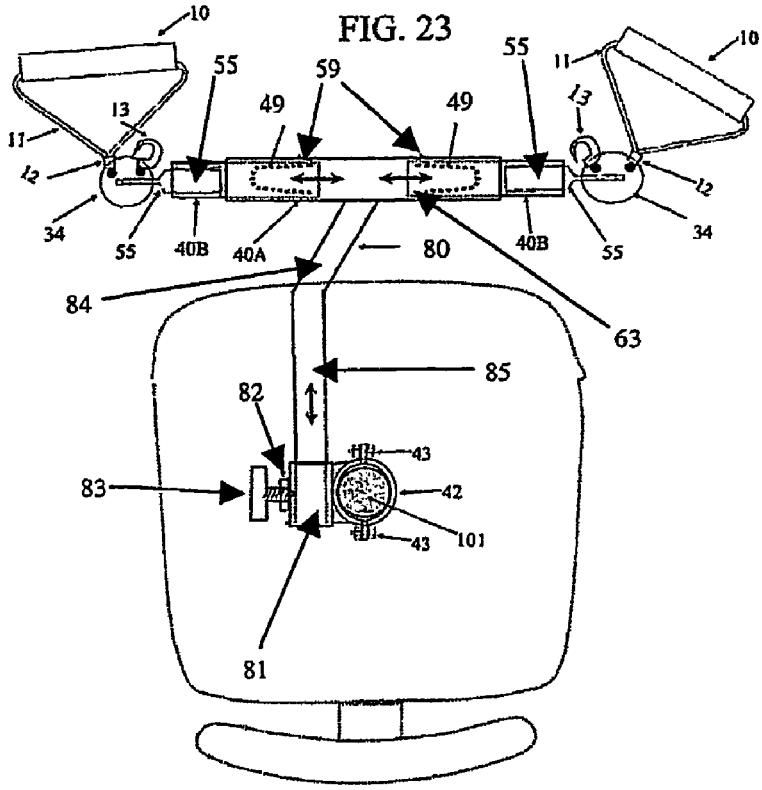
FIG. 23 is a top view schematic of the chair attachment means FIG. 22 with the primary arm extended fully.

An alternative means of adjustment is illustrated in FIGS. 22 and 23 where the outer sleeve 40A has a series of holes (not shown) disposed laterally across the length of the sleeve 40A and aligned linearly. Each inner sleeve 40B includes a spring clip 49, formed in a U-shape, which is attached to the inside of the inner sleeve 40B at a point marked 63. The opposite arm of the clip 49 has a cylindrical protuberance 59, which is biased by the spring clip 40 to exit through an aperture (not shown) in the inner sleeve 40B and pass through one of the holes in the outer sleeve 40A. In this manner, the inner sleeve 40B is locked with the outer sleeve 40A against sliding movement by the shear resistance of the protuberance 59 in the holes of the outer sleeve 40A. The protuberance 59 is sized to be comfortably moved through the holes in the outer sleeve 40A.

In operation, the distance by which the inner sleeves 40B extend from the outer sleeve 40A is adjusted by a user depressing the protuberance 59 back through the hole in the outer sleeve 40A which it presently occupies, to release inner sleeve 40B from engagement with the outer sleeve 40A. The user may then adjust the length of the inner sleeve 40B to a desired position whereon the user allows the protuberance 59 to spring back through the nearest hole in the outer sleeve 40A thereby locking the inner and outer sleeves 40B, 40A together.

Figure 13:
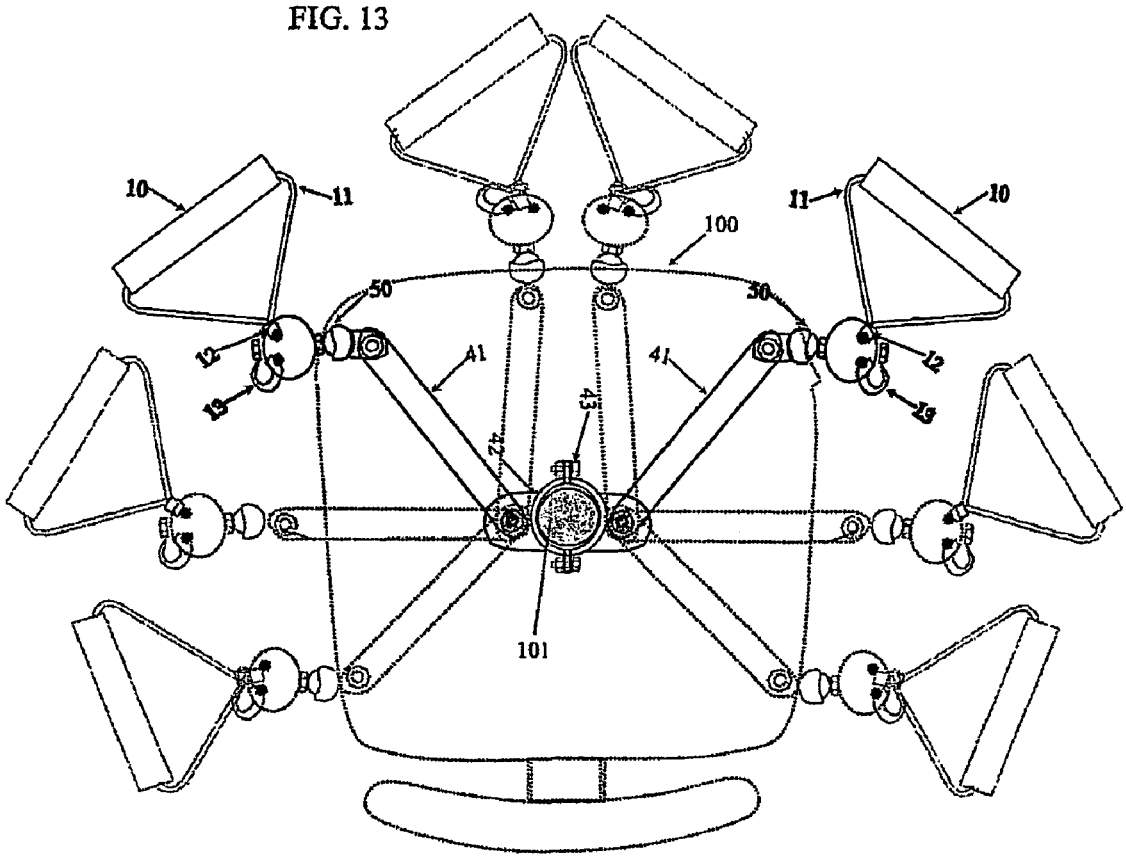
FIG. 13 is a top perspective of an alternative chair attachment means with two swing arms and showing freedom of movement available in the exercise device.
Figure 14:
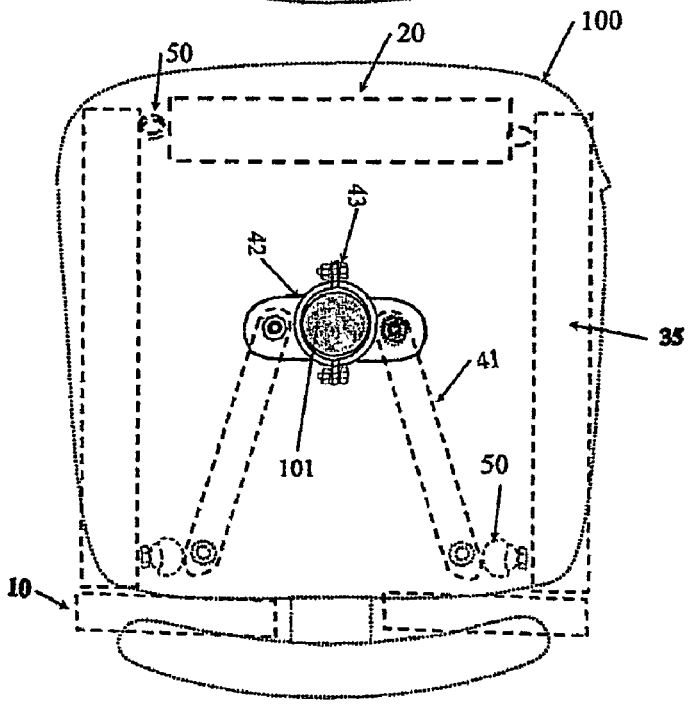
FIG. 14 is a top view of the chair attachment means in FIG. 13 in a storage position.
Figure 15:
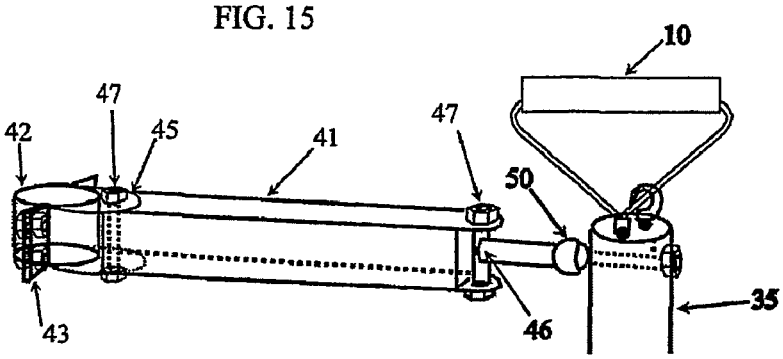
FIG. 15 is a perspective of a swing arm of the chair attachment means in FIG. 13.

In another preferred embodiment shown in FIGS. 13 to 17 the two arms 41 are hinged at the semi-circular portion of the clamp 42, 43 with a bracket 45 and a nut and bolt 47. At the other end of the arms 41 the universal joints 50 are hinged by a nut and bolt 47 for pivotal movement about the vertical axis of the bolt 47. FIG. 13 depicts the range of movement available with the pivotable arms 41. It will be appreciated that the arms 41 allow the resistance means 30 to move in a plane parallel to the ground from a position between the users legs through to the rear of the office chair. By moving the arms 41 to their rear most position, the second operating means and resistance means 30 may be moved to a position flush under the office chair for out-of-the-way storage.

Figure 12:
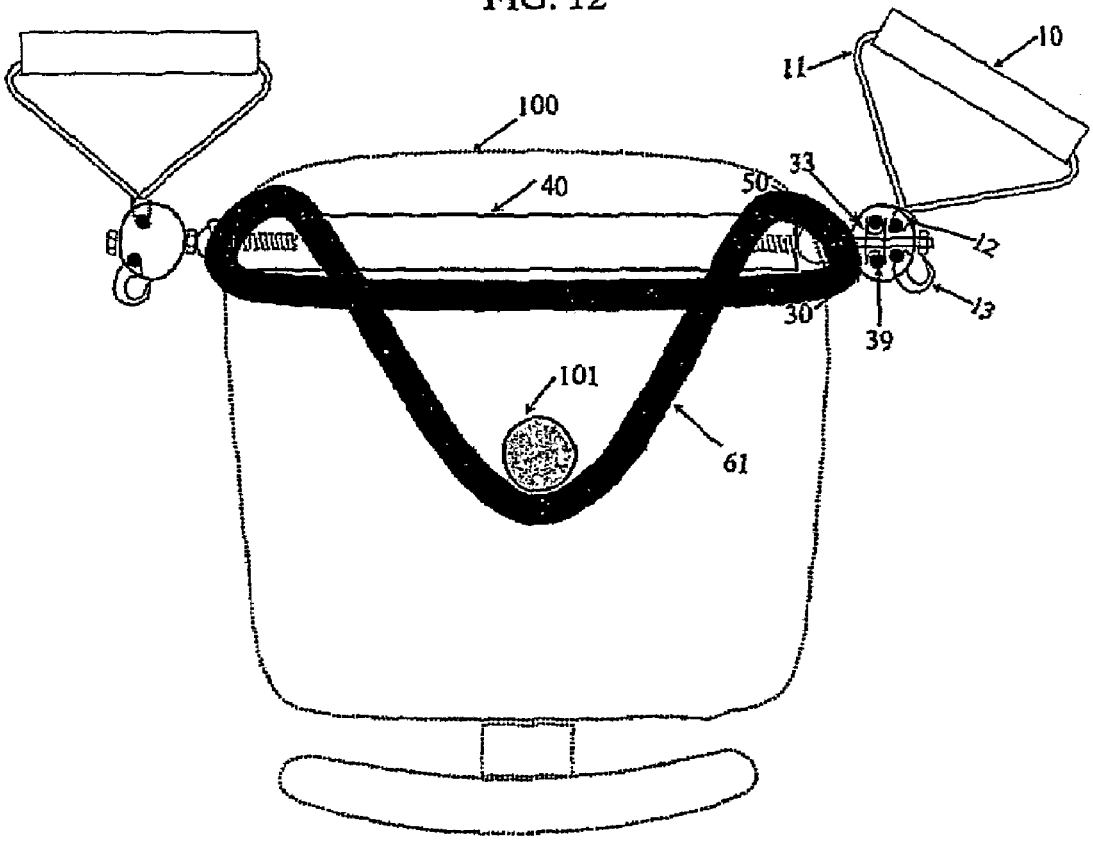
FIG. 12 is a top perspective of a chair attachment means comprising straps.

In another preferred embodiment the chair attachment means may comprise a strap 61, as shown in FIG. 12, or a series of straps with buckles.

In a further alternative, the extendible bar 40 is mounted to the chair post 101 via a strut 80 and sleeve 81, as in FIGS. 22 and 23, which permit movement of the bar 40 relative to the post 101. In this embodiment, the bar 40 may be rigidly or pivotally attached to the strut 80 by any appropriate means of attachment.

The strut 80 has a rectangular cross-section, however alternatively shaped cross-sections may otherwise be used. A sleeve 81, mounted to the clamp 42, 43, has a cross-section corresponding to the cross-section of the strut 80 and is adapted in terms of size to snugly receive the strut 80 whilst permitting sliding movement of the strut 80 through the sleeve 81. A side of the sleeve 81 includes an aperture (not shown) over which a nut 82 is fixed on the outer surface of the side of the sleeve 81. Alternatively, the aperture may include a thread adapted to engage with a correspondingly threaded bolt 83. A bolt 83 is used to threadedly engage with the nut 82 such that tightening the bolt 83 acts to clamp the strut 80 in the sleeve 81 thereby preventing sliding movement of the strut 80 relative to the sleeve 81. Accordingly, the position of the strut 80 relative to the sleeve 81 is adjustable by releasing the bolt 83, moving the strut 80 and re-tightening the bolt 83.

The strut 80 is preferably divided into first and second portions 85, 84, respectively. The first portion 85 permits adjustment of the position of the bar 40 relative to the sleeve 81, as discussed above. The second portion 84 is oblique to the first portion 85 so that the bar 40 is supported in its middle by accounting for the offset of the sleeve 81.

When appropriately adjusted to fit the chair the extension bar 40 should be approximately equal in length to the width of the chair 100. Attached to each end of the extension bar 40 are universal joints 50. The universal joints 50 preferably comprise ball and socket joints. The socket portion of the joint is mounted in the end of the extension bar 40 and the ball portion includes a bolt 51. The bolt 51 passes through holes on opposing sides near the top of the uppermost component 31 of the resistance means 30. The ball and socket joints 50 provide the resistance means 30 with freedom of pivotal movement in all directions whereby this freedom is only limited by the extent to which the bolt 51 interferes with the socket housing around the ball.

While the ball and socket joint is the preferred means of joining extension bar 40 to resistance means 36 for universal movement, other universal joints may be equally applicable. For instance, coupled rings or a flexible polymer.

In one particular embodiment shown in FIGS. 18 to 23 the resistance means 30 is attached to the chair attachment means 40, 41, 42, 43 via a bush 57 and arm 55 mounted in the outer and inner sleeves 40A and 40B, each being cylindrical tubes in this instance.

Each arm 55 has a flat rectangular plate section 58 with a hole 53 therethrough for receipt of a bolt 51 on which a pulley 33 is mounted to enable rotation of the bolt 51. This enables the resistance means 30 to be attached to the chair attachment means 40, 41, 42, 43 rather than via the housing 35. The arms 55 also have a cylindrical section 60 with two lugs 56A, 56B spaced apart at opposite ends of the cylindrical section and radially aligned.

The cylindrical section 60 has a diameter marginally less than the inner diameter of the bush 57 such that the arm 55 can freely rotate about a central longitudinal axis of the cylindrical section 60. The bush 57 is formed as a cylindrical tube with a longitudinal gap along one side. Collectively, the rotation of the arm 55 in the bush 57 and the bolt 51 in the hole 53 provide universal movement of the resistance means relative to the inner and outer sleeves.

Figure 19:
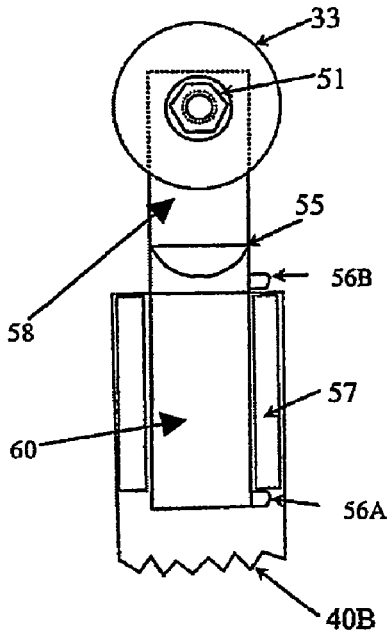
FIG. 19 is front schematic view of the alternative mounting means in FIG. 18 without the pulleys and elastic cord.
Figure 20:
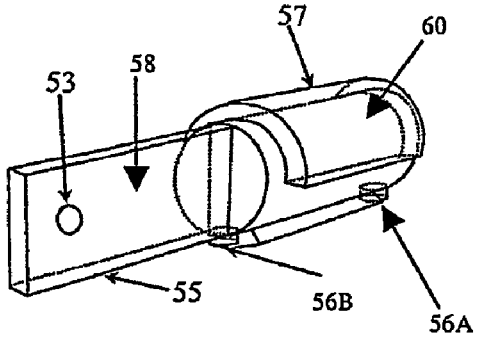
FIG. 20 is perspective schematic of the mounting means in FIG. 18 in a locked position.
Figure 21:
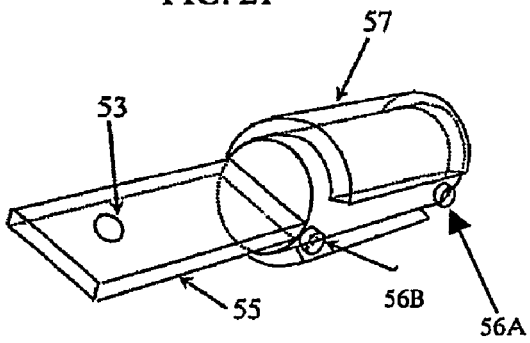
FIG. 21 is perspective schematic the mounting means in FIG. 18 in an unlocked position.

As shown in FIG. 19, the lugs 56A, 56B have a height above the surface of the cylindrical section 60 less than the width of the tube wall of the bush 57. Accordingly, the arm 55 may be moved into engagement with the bush 57 by aligning the lugs 56A, 56B with the gap in the bush 57 and inserting the arm 55 until the lug 56A has cleared the bush 57. Rotating the arm 55, until the lugs 56A, 56B are no longer aligned with the gap, locks the arm with the bush 57. The arm 55 is removed by following the above process in reverse.

The resistance means depicted in FIGS. 6 to 9 will now be described. The resistance means 30 comprises a housing 35 preferably consisting of three telescopic components 34, 31, 32 which allows for extension of the resistance means 30 without exposure of the elasticised cord 39 to interference by objects or people's fingers from outside the housing 35. In other embodiments the housing 35 may comprise as little as one or as many as five components.

The first bolt 51 passing through the top of the uppermost component 34 of the housing 35 has a pulley wheel 33 rotatably mounted thereon. A second bolt 52 passing through the opposing sides of the bottom of the lowermost component 32 of the housing 35 has two pulley wheels 36, 37 mounted thereon for rotation. The bolt 51 and second bolt 52 are substantially parallel in alignment.

The elastic cord 39 is attached to handle 10 by a deformable metal grip clamp 12 or other appropriate means of fastening. The elastic cord 39 then passes into the housing 35 through an aperture in the roof of the uppermost component 34 and around pulley wheels 36, 33, 37 (in that order). The elastic cord 39 then passes through a second aperture in the roof of the uppermost component 34 and terminates in an attachment with a hook 13. The bottom of the hook 13 has a dimension greater than the diameter of the second aperture such that the elastic cord 39, when the resistance means 30 is at rest or under extension by the user, biases the bottom of the hook 13 into abutment with the roof of the uppermost component 34. The elastic cord 39 allows the user to lift handle 10 from a resting position by their thigh to full arm extension above the user's head.

An alternative handle 10 is shown in FIGS. 24 to 27. The handle 10 comprises a grip 5 and a U-shape tube 7. The tube 7 has an opening 9 extending from an abutment 19, around the end 17 and along the inside of the U-shape to terminate at an aperture 11. In this embodiment, the elastic cord 39 terminates at both ends in balls 15 which are dimensioned to fit through the aperture 11 and slide freely through the cavity inside the tube 7, as in FIG. 26.

The handle 10 is fitted to the resistance means 30 by inserting one or both balls 15 through the aperture 11. For a single ball 15, as in FIG. 26, the opening 9 permits movement of the ball 15 through the inside cavity of the tube 7 until the elastic cord 39 hits the abutment 19. In this position the handle 10 is ready for use where inclination of the handle 10 toward the curved portion of the U-shaped tube 7 positively locks the ball 15 and elastic cord 39 against the abutment 19 when tension is placed on the elastic cord 39. Alternatively, if double the resistance is desired, both balls 15 may be inserted into the handle.

Figure 24:
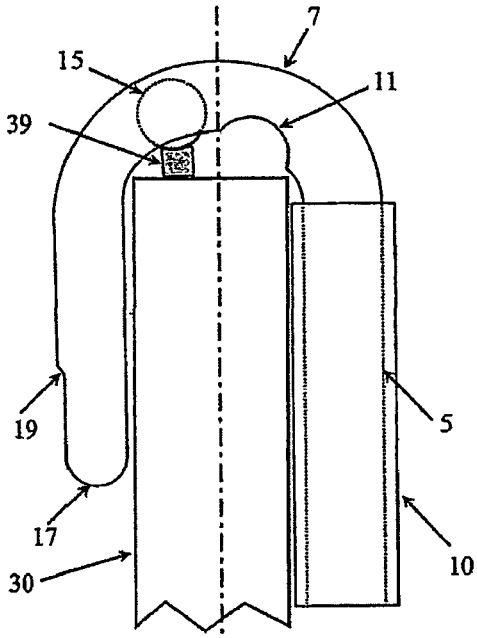
FIG. 24 is a schematic side view of a further handle embodiment in a storage position on top of the housing for the resistance means.
Figure 26:
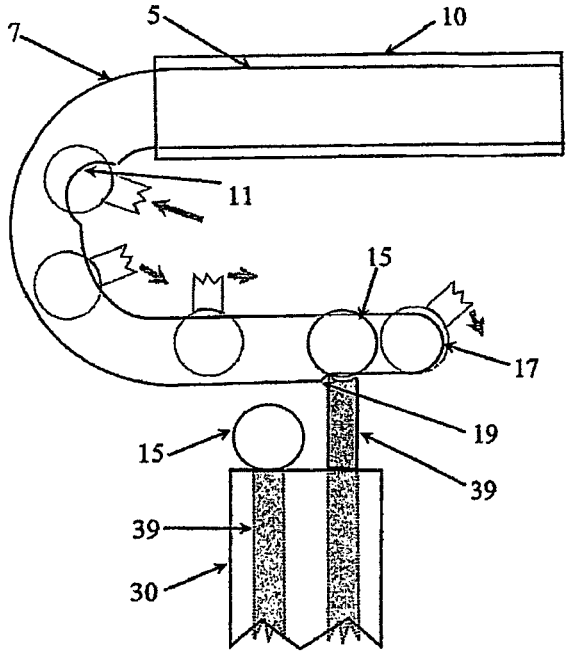
FIG. 26 is a schematic side view of the handle in FIG. 24 in the operating position on top of the housing.
Figure 25:
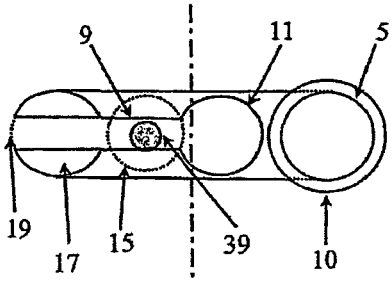
FIG. 25 is a schematic end view of the handle in FIG. 24.
Figure 27:
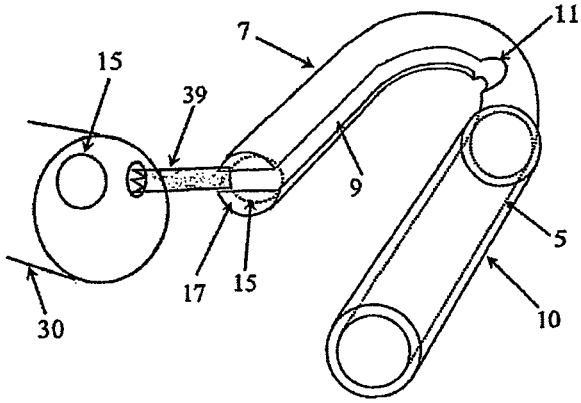
FIG. 27 is a perspective schematic of the handle in FIG. 26 in the operating position.
Figure 28:
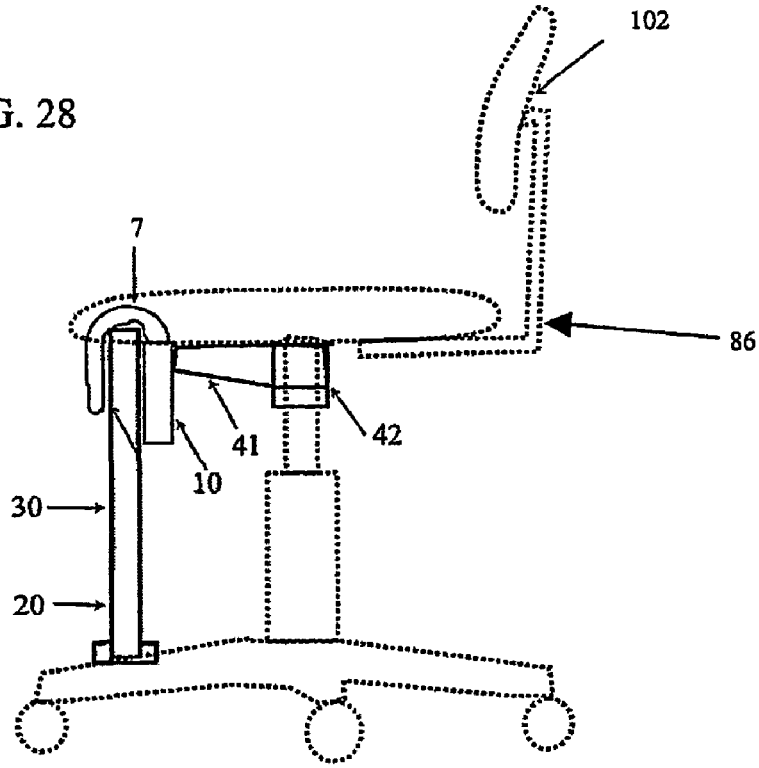
FIG. 28 is a side view of a portable exercise device with the handle in FIG. 24 in the storage position.
Figure 29:
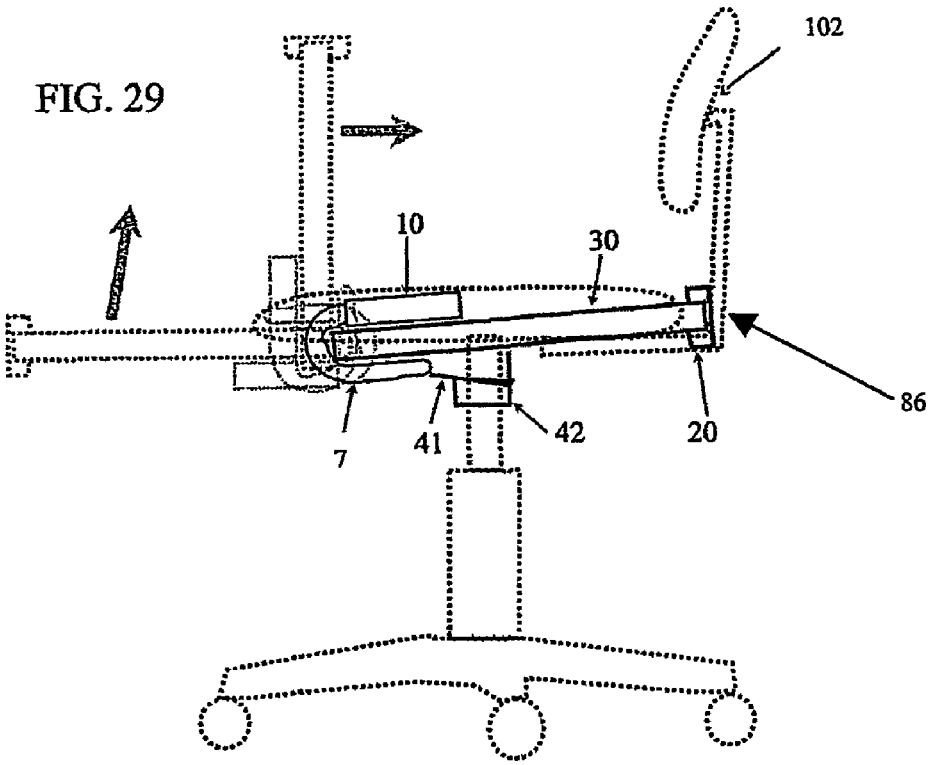
FIG. 29 illustrates movement of the device in FIG. 28 to a storage position.

The handle 10 is movable to a storage position, as shown in FIG. 24, where the ball 15 is adjacent the aperture 11 and the U-shaped tube 7 sits on top of the resistance means 30 by the resilience inherent in the elastic cord 39. FIGS. 28 and 29 show how the exercise device may be moved to a storage position where the common bar 20 is flipped over the top of the seat to rest on a bracket 86 which supports the chair back 102.

The second bolt 52 of each resistance means 30 is attached to a universal joint 50, preferably a ball and socket joint, which is in turn attached to a common operating means 20 which acts to connect the lowermost components 32 of each resistance means 30. In practice, the user places both feet on the common operating means 20 and pushes the common operating means 20 to exercise their legs against the resistance provided by the resistance means 30.

Figure 16:
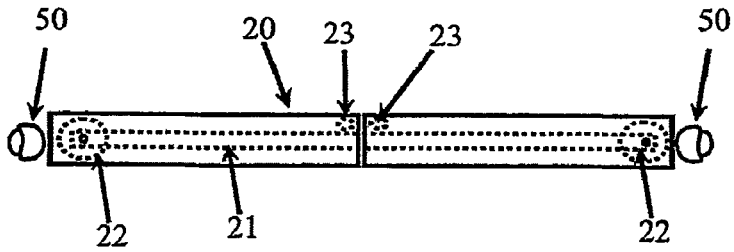
FIG. 16 is a front schematic of alternative second operating means including an expanding resistance means shown in the rest position.
Figure 17:
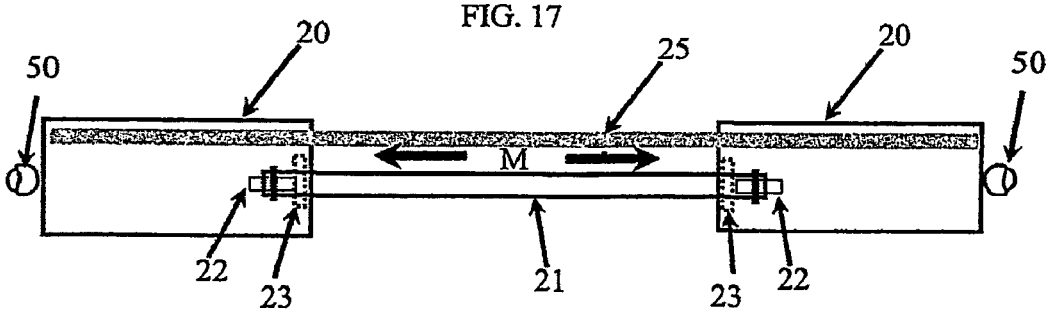
FIG. 17 is a top schematic of the alternative second operating means of FIG. 13 shown in the expanded position.
Figure 18:
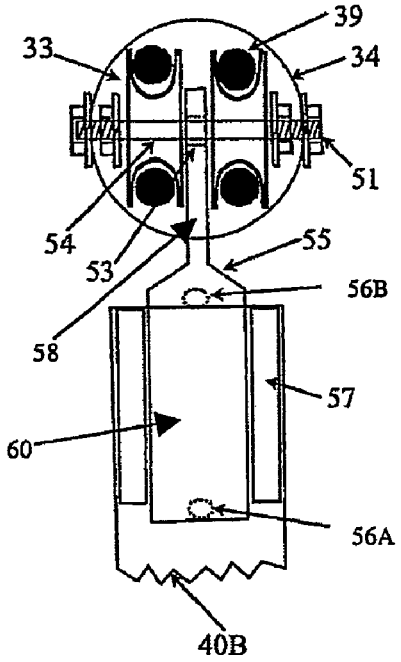
FIG. 18 is a top view schematic of an alternative means for mounting the resistance means to the chair attachment means.

The common operating means 20 preferably comprises a solid bar or tube, however, in an alternative embodiment, shown in FIGS. 16 and 17, the bar or tube may be substituted by an extendable footrest 20, 21, 25 incorporating an elastic resistance means 25 which biases the extendable footrest 20, 21, 25 against extension. The elastic resistance means 25 preferably comprises an elastic cord but may alternatively be a coil spring or elastic strap.

The outer end of each footrest 20 is attached to the lowermost component 32 of the housing 35 by a universal joint 50 and bolt 52. The footrests 20 are attached together, firstly, by the elastic resistance means 25 and, secondly, a support bar 21 which allows slidable movement of the footrests 20 coaxial with the support bar 21. This sliding movement is facilitated by wheels 22 disposed on both ends of the support bar 21 and rollers 23 attached on the inside ends of the footrests 20 above the support bar 21. When a user pushes against the footrest 20 the force is distributed through the roller 23 and wheel 22 and allows the footrest to be smoothly extended against the resistance provided by the elastic resistance means 25. in this manner, the user can place each foot on each respective outer footrest 20 and perform a scissor type motion with their legs to extend the extendable footrest 20, 21, 25 against the elastic resistance means 25 and thereby exercise leg and groin muscles.

The construction of the resistance means 30, described above, means that when the user pulls the handle 10 the entire length of the elastic cord 39 is subject to extension as a single means of resistance. However, where the user pushes on the common operating means 20, considering one resistance means 30 only, the arrangement of the pulley wheels 33, 36, 37 and termination of elastic cord 39 in the hook 13 and handle 10 results in the user having to push against four elastic cord 39 sections. Thus, the resistance provided to the user in extending the resistance means 30 through the common operating means 20 is four times greater than the resistance to the user in pulling on the handle 10. Effectively this is a 4:1 ratio of resistance between common bar 20 and handle 10 extension.

The exercise device may, however, be adapted to provide different resistance ratios. For example, attaching a hook 13 on the handle 10 results in the user pulling against both ends of the elastic cord 39 and, essentially, doubles the resistance through the handles. The common operating means 20/handle 10 resistance ratio would then be 4:2. The resistance through the handles 10 may otherwise be varied by extending the resistance means 30 by pushing on the common operating means 20 to place the elastic cord 39 under tension. Extension of the elastic cord 39 through the use of the handles 10 then requires an increased effort to overcome the initial tension in the cord 39. Further, alternative embodiments allow the addition or subtraction of pulley wheels to modify the resistance ratio.

It will be appreciated that various modifications and alterations may be made to the preferred embodiment of the portable exercise device described above without departing from the scope and spirit of the invention.

It will also be understood that the term "comprises" (or its grammatical variants) as used in this specification is equivalent to the term "includes" and should not be taken as excluding the presence of other elements or features.

The invention claimed is:

1. An exercise device for mounting to a chair, comprising:

a chair mounting means for securing the exercise device to the chair;

a first resistance means, including a resilient means having a length at rest;

the resilient means being linked to a hand operating means and a foot operating means, whereby movement of the hand operating means, the foot operating means or both permits exercise against the resilient means; wherein when the exercise device is secured to the chair, a resistance against extension of the resilient means by movement of the foot operating means by a given amount is greater than a resistance against extension of the resilient means by movement of the hand operating means by said given amount; and wherein an intermediate portion of the resilient means is looped around a plurality of spaced pulleys such that the hand operating means and the foot operating means are spaced by a distance that is less than a length of the resilient means when the resilient means is at rest.

2. The exercise device as claimed in claim 1, wherein the hand operating means and the foot operating means are adaptable, during exercise, to be spaced by a distance greater than said length at rest.

3. The exercise device according to claim 1, wherein at least one of the plurality of pulleys is associated with the foot operating means for movement therewith.

4. The exercise device according to claim 1, wherein respective opposite ends of the resilient means are linked to the hand operating means and a fixture.

5. The exercise device according to claim 1, wherein the device includes a second resistance means.

6. An exercise device for mounting to a chair, comprising:

a chair mounting means for securing the exercise device to the chair;

a first resistance means, including a resilient means having a length at rest;

the resilient means being linked to a hand operating means and a foot operating means, whereby movement of the hand operating means, the foot operating means or both permits exercise against the resilient means; wherein when the exercise device is secured to the chair, a resistance against extension of the resilient means by movement of the foot operating means by a given amount is greater than a resistance against extension of the resilient means by movement of the hand operating means by said given amount;

second resistance means; and wherein the foot operating means is connected to both resistance means and is adapted for use with both of the user's feet, whereby movement of the foot operating means is against both resistance means.

7. The exercise device according to claim 6, wherein the foot operating means is one of a bar, a rod and a tube.

8. The exercise device according to claim 6, wherein the foot operating means is an extendable footrest with two separate foot-receiving means adapted for relative slidable movement, whereby the two separate foot-receiving means are biased together by a third resistance means, such that movement of the two foot-receiving means permits exercise against the third resistance means.

9. The exercise device according to claim 8, wherein the slidable movement of the two foot-receiving means is coaxial with a support bar joining the two foot-receiving means.

10. The exercise device according to claim 1, wherein the chair-mounting means permits removable mounting of the device to the chair for portability.

11. The exercise device according to claim 1, wherein the device is adapted to be removably mounted on the chair and the chair is a standard office chair.

12. The exercise device according to claim 10, wherein the removable mounting means further includes a central mounting device and one or more arms extending from the central mounting device, and wherein each of the one or more arms supports a respective resistance means.

13. An exercise device for mounting to a chair, comprising:

a chair mounting means for securing the exercise device to the chair;

a first resistance means, including a resilient means having a length at rest;

the resilient means being linked to a hand operating means and a foot operating means, whereby movement of the hand operating means, the foot operating means or both permits exercise against the resilient means; wherein when the exercise device is secured to the chair, a resistance against extension of the resilient means by movement of the foot operating means by a given amount is greater than a resistance against extension of the resilient means by movement of the hand operating means by said given amount;

wherein the chair-mounting means permits removable mounting of the device to the chair for portability;

wherein the removable mounting means further includes a central mounting device and one or more arms extending from the central mounting device, and wherein each of the one or more arms supports a respective resistance means; and wherein the central mounting device includes a clamp and wherein each of the one or more arms is pivotable about an axis coaxial with an axis of the clamp.

14. An exercise device for mounting to a chair, comprising:

a chair mounting means for securing the exercise device to the chair;

a first resistance means, including a resilient means having a length at rest;

the resilient means being linked to a hand operating means and a foot operating means, whereby movement of the hand operating means, the foot operating means or both permits exercise against the resilient means; wherein when the exercise device is secured to the chair, a resistance against extension of the resilient means by movement of the foot operating means by a given amount is greater than a resistance against extension of the resilient means by movement of the hand operating means by said given amount;

wherein the chair-mounting means permits removable mounting of the device to the chair for portability;

wherein the removable mounting means further includes a central mounting device and one or more arms extending from the central mounting device, and wherein each of the one or more arms supports a respective resistance means; and wherein each of the one or more arms is pivotable between a first operating position and a second position wherein the resistance means extend rearwardly of the chair for out-of-the-way storage.

15. The exercise device according to claim 1, wherein the resilient means, at rest, is located within a housing.

16. The exercise device according to claim 1, wherein the hand operating means is a handle.

* * * * *